United States Patent [19]

Ishikawa et al.

[11] 4,432,324

[45] Feb. 21, 1984

[54] AIR-FUEL RATIO CONTROL DEVICE OF AN INTERNAL COMBUSTION ENGINE

[75] Inventors: Norikatsu Ishikawa, Mishima; Haruyuki Obata; Takao Tate, both of Susono; Toshio Tanahashi, Susono; Hiromi Otsuki, Anjo, all of Japan

[73] Assignees: Toyota Jidosha Kogyo Kabushiki Kaisha, Toyota; Nippondenso Co., Ltd., Kariya, both of Japan

[21] Appl. No.: 364,455

[22] Filed: Apr. 1, 1982

[30] Foreign Application Priority Data

Apr. 8, 1981 [JP] Japan ..... 56-51747
Apr. 8, 1981 [JP] Japan ..... 56-51748

[51] Int. Cl.[3] ..... F02B 33/00; F02M 7/00

[52] U.S. Cl. ..... 123/438; 137/533.17; 251/129

[58] Field of Search ..... 123/440, 438, 585, 589; 137/533.17; 251/129, 141; 261/121 B

[56] References Cited

U.S. PATENT DOCUMENTS

| | | | |
|---|---|---|---|
| 4,105,726 | 8/1978 | Lindberg | 123/440 |
| 4,181,108 | 1/1980 | Bellicardi | 123/440 |
| 4,287,864 | 9/1981 | Takada | 123/440 |
| 4,314,536 | 2/1982 | Tipton | 123/440 |
| 4,320,731 | 3/1982 | Braun | 123/440 |
| 4,345,560 | 8/1982 | Nakamura | 123/440 |

*Primary Examiner*—Ronald B. Cox
*Attorney, Agent, or Firm*—Cushman, Darby & Cushman

[57] ABSTRACT

An internal combustion engine comprising a carburetor which has a main air bleed passage and a slow air bleed passage. An air-fuel ratio of the mixture fed into the cylinder of an engine is so controlled that it becomes equal to the stoichiometric air-fuel ratio by a single electromagnetic control valve arranged in the main air bleed passage and the slow air bleed passage. The control valve comprises a first reed valve arranged in the slow air bleed passage, a second reed valve arranged in the main air bleed passage, and an electromagnetic device simultaneously actuating the first reed valve and the second reed valve while maintaining the opening area of the first reed valve at an area which is larger than the opening area of the second reed valve.

16 Claims, 15 Drawing Figures

AIR-FUEL RATIO CONTROL DEVICE OF AN INTERNAL COMBUSTION ENGINE

BACKGROUND OF THE INVENTION

The present invention relates to an air-fuel ratio control device of an internal combustion engine.

As a method of simultaneously reducing the amount of harmful HC, CO and $NO_x$ components in the exhaust gas, a method has been known in which a three way catalytic converter is arranged in the exhaust passage of an engine.

The purifying efficiency of the three way catalyzer becomes maximum when the air-fuel ratio of the mixture fed into the cylinder of an engine becomes equal to the stoichiometric air-fuel ratio. Consequently, in the case wherein a three way catalytic converter is used for purifying the exhaust gas, it is necessary to equalize the air-fuel ratio of the mixture fed into the cylinder to the stoichiometric air-fuel ratio. As an air-fuel ratio control device capable of equalizing the air-fuel ratio of the mixture fed into the cylinder of an engine to the stoichiometric air-fuel ratio, an air-fuel ratio control device has been known in which a main air bleed passage is connected to a main fuel passage which is in communication with the main nozzle of a carburetor, and a slow air bleed passage is connected to a slow fuel passage which is in communication with the slow fuel port of the carburetor. A main electromagnetic control valve for controlling the amount of air bled into the main fuel passage, and a subelectromagnetic control valve for controlling the amount of air bled into the slow fuel passage are arranged in the main air bleed passage and the slow air bleed passage, respectively. An oxygen concentration detector is arranged in the exhaust passage of the engine, and the output signal of the oxygen concentration detector is converted to a control signal by an electronic control unit. The main electromagnetic control valve and the subelectromagnetic control valve are driven by the control signal and, thereby, the amount of air fed into the main fuel passage from the main air bleed passage and fed into the slow fuel passage from the slow air bleed passage are controlled so that the air-fuel ratio of the mixture fed into the cylinder of the engine approaches the stoichiometric air-fuel ratio. In this air-fuel ratio control device, the main electromagnetic control valve and the subelectromagnetic control valve are so constructed that the opening areas thereof are proportional to the potential level of the control signal issued from the electronic control unit and, in addition, since the relationship between the opening area of the main electromagnetic control valve and the potential level of the control signal is the same as the relationship between the opening area of the subelectromagnetic control valve and the potential level of the control signal, the opening area of the main electromagnetic control valve is the same as that of the subelectromagnetic control valve.

As is known to those skilled in the art, in a carburetor, when the opening degree of the throttle valve is small, fuel is fed from the slow fuel port, but fuel is not fed from the main nozzle. Contrary to this, when the opening degree of when fuel is fed from only the slow fuel port, that is, when the opening degree of the throttle valve is small, is larger than the opening area of the main electromagnetic control valve, which is necessary to equalize the air-fuel ratio of the mixture to the stoichiometric air-fuel ratio when fuel is mainly fed from the main nozzle, that is, when the opening degree of the throttle valve is large. Consequently, in the case wherein the main electromagnetic control valve and the subelectromagnetic control valve are so constructed that the opening area of the main electromagnetic control valve is always equal to the opening area of the subelectromagnetic control valve, as in a conventional air-fuel ratio control device, when, for example, the throttle valve is abruptly opened from a small opening degree to a great extent, the main electromagnetic control valve has an opening area which is larger than the opening area necessary to equalize the air-fuel ratio of the mixture to the stoichiometric air-fuel ratio. As a result of this, during the time the main electromagnetic control valve is set to an opening degree which is necessary to equalize the air-fuel ratio of the mixture to the stoichiometric air-fuel ratio, the mixture fed into the cylinder of the engine becomes lean. Therefore, since a satisfactory high output power of the engine cannot be obtained, a problem occurs in that a good accelerating operation of the engine cannot be obtained.

An object of the present invention is to provide an air-fuel ratio control device capable of obtaining a good accelerating operation of an engine by preventing the mixture fed into the cylinder of the engine from temporarily becoming lean when the throttle valve is opened.

According to the present invention, there is provided an air-fuel ratio control device of an internal combustion engine having at least one cylinder, an intake passage and an exhaust passage, said device comprising: a carburetor arranged in the intake passage and having a float chamber, a main nozzle, a main fuel passage connecting said float chamber to said main nozzle, a main air bleed passage connecting said main fuel passage to the atmosphere, a slow fuel port, a slow fuel passage connecting said float chamber to said slow fuel port, a slow air bleed passage connecting said slow fuel passage to the atmosphere; valve means having a first valve arranged in said slow air bleed passage for controlling the flow area of said slow air bleed passage, a second valve arranged in said main air bleed passage for controlling the flow area of said main air bleed passage, and an electromagnetic device common to said first valve and said second valve and simultaneously actuating said first valve and said second valve while maintaining the flow area of said slow air bleed passage at an area which is larger than the flow area of said main air bleed passage; an oxygen concentration detector arranged in the exhaust passage and detecting components of the exhaust gas in the exhaust passage for producing a detecting signal having a potential level which becomes high or low when an air-fuel ratio of the mixture fed into the cylinder becomes smaller or larger than the stoichiometric air-fuel ratio, respectively, and; an electronic control unit operated in response to the detecting signal of said oxygen concentration detector and producing a control signal for operating said electromagnetic device to actuate said first valve and said second valve so that the air-fuel ratio of said mixture becomes equal to the stoichiometric air-fuel ratio.

The present invention may be more fully understood from the description of preferred embodiments of the invention set forth below, together with the accompanying drawings.

DESCRIPTION OF PREFERRED EMBODIMENTS

Figure 1:
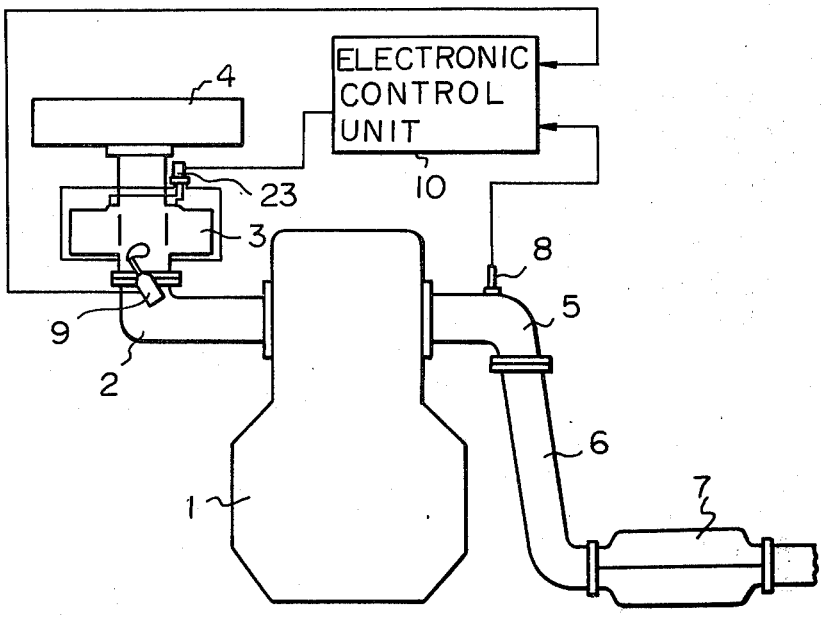
FIG. 1 is a front view of an internal combustion engine.

Referring to FIG. 1, 1 designates an engine body, 2 an intake manifold, 3 a carburetor and 4 an air cleaner; 5 designates an exhaust manifold, 6 an exhaust pipe connected to the exhaust manifold 5, 7 a three-way catalytic converter connected to the exhaust pipe 6 and 8 an oxygen concentration detector arranged in the exhaust manifold 5; 9 designates an idle switch and 10 an electronic control unit. The oxygen concentration detector 8 and the idle switch 9 are connected to the electronic control unit 10.

Figure 2:
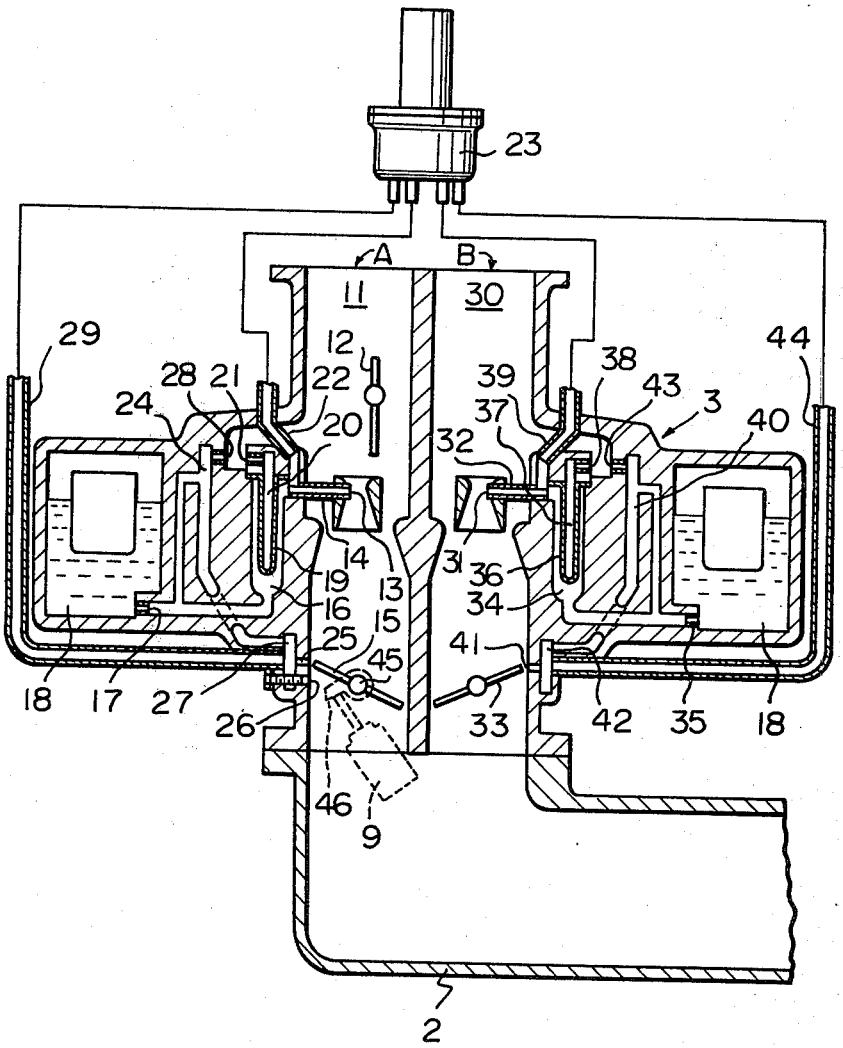
FIG. 2 is a cross-sectional side view of a carburetor according to the present invention.

Referring to FIG. 2, a carburetor 3 comprises a primary carburetor A and a secondary carburetor B. The primary carburetor A comprises an air horn 11, a choke valve 12, a main nozzle tube 14 having a nozzle mouth 13, and a primary throttle valve 15. The main nozzle tube 14 is connected to a float chamber 18 via a main fuel passage 16 and a main jet 17. An emulsion tube 19 is arranged in the main fuel passage 16, and the interior chamber 20 of the emulsion tube 19 is connected to the air horn 11 via a fixed jet 21. In addition, the inner end of the main nozzle tube 14 is connected to an electromagnetic control valve 23 via an air bleed conduit 22. A slow fuel passage 24 is branched off from the main fuel passage 16, and connected to a fuel outflow chamber 27 having a slow fuel port 25 and an idle fuel port 26 which open into the air horn 11 in the vicinity of the primary throttle valve 15. In addition, the slow fuel passage 24 is connected to the air horn 11 via a jet 28 and the fuel outflow chamber 27 is connected to the electromagnetic control valve 23 via an air bleed conduit 29.

The secondary carburetor B comprises an air horn 30, a main nozzle tube 32 having a nozzle mouth 31, and a secondary throttle valve 33. The main nozzle tube 32 is connected to the float chamber 18 via a main fuel passage 34 and a main jet 35. An emulsion tube 36 is arranged in the main fuel passage 34 and the interior chamber 37 of the emulsion tube 36 is connected to the air horn 30 via a fixed jet 38. In addition, the inner end of the main nozzle tube 32 is connected to the electromagnetic control valve 23 via an air bleed conduit 39. A slow fuel passage 40 is branched off from the main fuel passage 34 and connected to a fuel outflow chamber 42 having a slow fuel port 41 which opens into the air horn 30 in the vicinity of the secondary throttle valve 33. The slow fuel passage 40 is connected to the air horn 30 via a fixed jet 43 and the fuel outflow chamber 42 is connected to the electromagnetic control valve 23 via an air bleed conduit 44. In addition, as illustrated in FIG. 2, an arm 46 is fixed onto a throttle shaft 45 of the primary throttle valve 15, and the idle switch 9 is so arranged that it engaged the arm 46. The idling switch 9 is in the ON position when the primary throttle valve 15 is in the idling position, while the idling switch 9 is turned to the OFF position when the throttle valve 15 opens.

Figure 3:
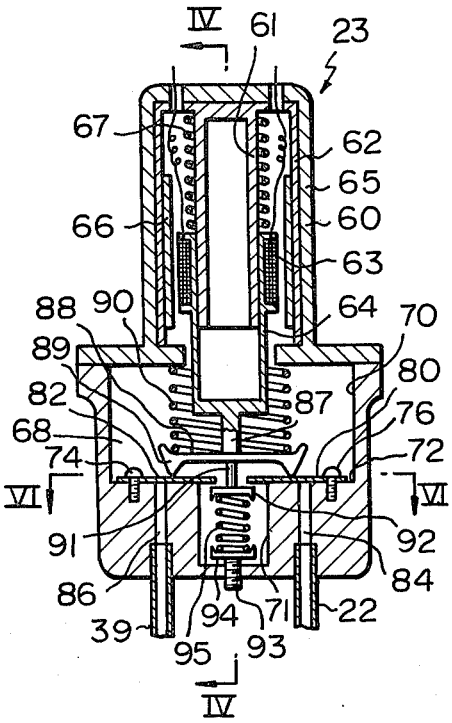
FIG. 3 is an cross-sectional side view of an electromagnetic control valve.
Figure 4:
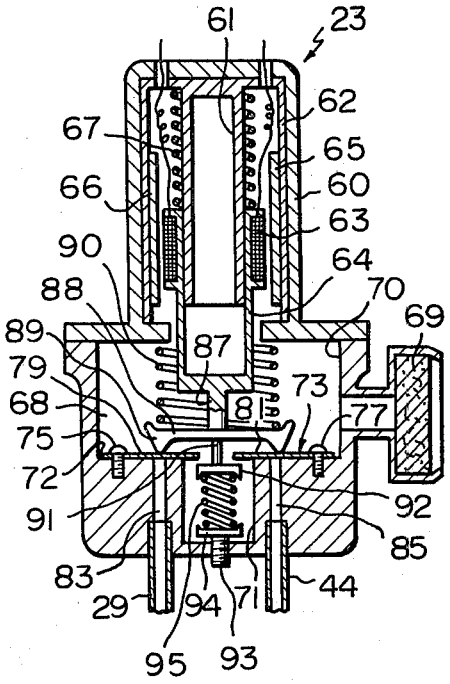
FIG. 4 is an cross-sectional side view taken along the line IV—IV in FIG. 3.
Figure 5:
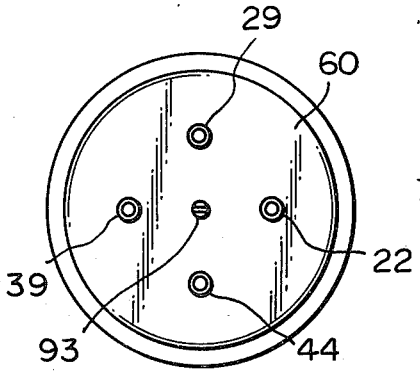
FIG. 5 is a bottom view of FIG. 3.
Figure 6:
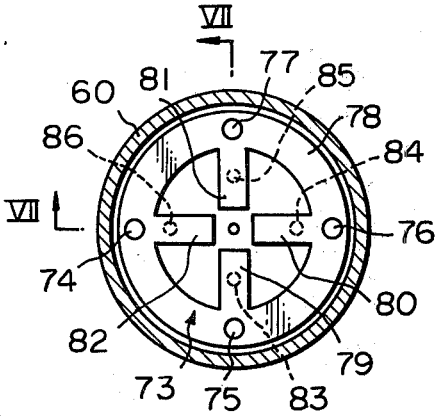
FIG. 6 is a cross-sectional plan view taken along the line VI—VI in FIG. 3.
Figure 7:
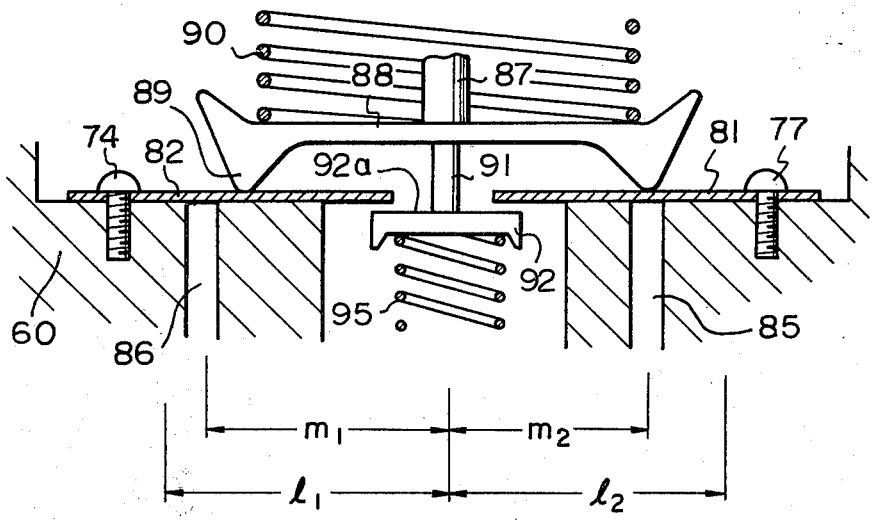
FIG. 7 is an enlarged cross-sectional view taken along the line VII—VII in FIG. 6.

Referring to FIGS. 3 through 5, the electromagnetic control valve 23 comprises a pair of hollow cylindrical stators 61, 62 made of ferromagnetic material and arranged in a housing 60, a sliding sleeve 64 slidably inserted onto the stator 61 and supporting a coil 63 thereon, cylindrical split permanent magnets 65, 66 fixed onto the inner wall of the stator 62, and a compression spring 67 for urging the sliding sleeve 64 downwards in FIG. 4. In addition, a valve chamber 68 is formed in the housing 60 and is open to the atmosphere via an air filter 69. The valve chamber 68 comprises an increased diameter portion 70, a reduced diameter portion 71 and a flat and annular step portion 72. A reed valve device 73, made of a thin plate having a circular contour shape, is fixed onto the annular step portion 72 by means of four screws 74, 75, 76, 77. This reed valve device 73 comprises an annular portion 78 extending along the circular contour thereof, and four reed valves 79, 80, 81, 82 extending straight out from the annular portion 78 towards the center of the reed valve device 73 and arranged in the form of a cross. On the other hand, air bleed bores 83, 84, 85 and 86, extending in the axial direction of the electromagnetic control valve 23, are formed in the housing 60 at positions located beneath the reed valves 79, 80, 81 and 82, respectively. As illustrated in FIGS. 2 and 4, the air bleed bore 83 is connected to the fuel outflow chamber 27 of the primary carburetor A via the air bleed conduit 29, and the air bleed bore 85 is connected to the fuel outflow chamber 42 of the secondary carburetor B via the air bleed conduit 44. In addition, as illustrated in FIGS. 2 and 3, the air bleed bore 84 is connected to the main nozzle tube 14 via the air bleed conduit 22, and the air bleed bore 86 is connected to the main nozzle tube 32 of the secondary carburetor B via the air bleed conduit 39. As illustrated in FIGS. 3 and 4, a rod 87 projects downwardly from the bottom end of the sliding sleeve 64, and a disc 88 is fixed onto the lower end of the rod 87. An annular projection 89, which is engageable with the reed valves 79, 80, 81, 82, is formed in one piece on the periphery of the lower end of the disc 88, and a compression spring 90 is inserted between the disc 88 and the upper wall of the valve chamber 68. In addition, another rod 91 projects downwardly from the center of the lower end face of the disc 88, and another disc 92 for controlling the opening operation of the electromagnetic control valve 23 is fixed onto the lower end of the rod 91. An adjusting screw 93 is screwed into the bottom wall of the reduced diameter portion 71 of the valve chamber 68, and the lower end of the adjusting screw 93 projects outwardly from the bottom wall of the housing 60. A spring retainer 94 is fixed onto the top of the adjusting screw 93, and a compression spring 95 is inserted between the spring retainer 94 and the disc 92.

Referring to FIGS. 3, 4, 6 and 7, the fulcrums of the reed valves 79, 80, 81, 82, that is, the positions of the root portions of the reed valves 79, 80, 81, 82 are so determined that the distances $l_1$, $l_2$ between the central axis of the electromagnetic control valve 23 and the fulcrums of the reed valves 79, 80, 81, 82 are the same length. That is, all the reed valves 79, 80, 81, 82 have the same length, and the reed valves 79, 80, 81, 82 are so arranged that the tips thereof are engageble with the upper wall 92*a* of the disc 92. On the other hand, the air bleed bores 83, 84, 85, 86 are so formed that the distance $m_1$ between the central axis of the electromagnetic control valve 23 and the air bleed bores 84, 86 is longer than the distance $m_2$ between the central axis of the electromagnetic control valve 23 and the air bleed bores 83, 85. Consequently, it will be understood that, when the disc 92 moves upward, the reed valves 79, 80, 81, 82 come into engagement with the disc 92 and simultaneously open the corresponding air bleed bores 83, 84, 85, 86, and that, when the disc 92 further moves upward, an increase in the opening areas of the reed valves 79, 81 is larger than that in the opening areas of the reed valves 80, 82.

In FIGS. 3 and 4, the cylindrical split permanent magnets 65, 66 are so formed that, for example, the polarity of the insides thereof is "N" and the polarity of the outsides thereof is "S". Consequently, a radial field is formed within the cylindrical split permanent magnets 65, 66. The coil 63 is wound so that, when an electric current flows in the coil 63, the coil 63 is subjected to a force causing the coil 63 to move upward in FIGS. 3 and 4. The above-mentioned force is strengthened as the amount of electric current fed into the coil 63 is increased. Therefore, the sliding sleeve 64 moves upward in FIGS. 3 and 4 against the spring force of the compression spring 67 as the amount of electric current fed into the coil 63 is increased. Consequently, when an electric current is fed into the coil 63, the sliding sleeve 64 moves upward, as mentioned above, and, thus, the reed valves 79, 80, 81, 82 simultaneously open the corresponding air bleed bores 83, 84, 85, 86. Then, the opening areas of the air bleed bores 83, 84, 85, 86, which are restricted by the reed valves 79, 80, 81, 82, respectively, are increased as the amount of electric current fed into the coil 63 is increased.

Figure 8:
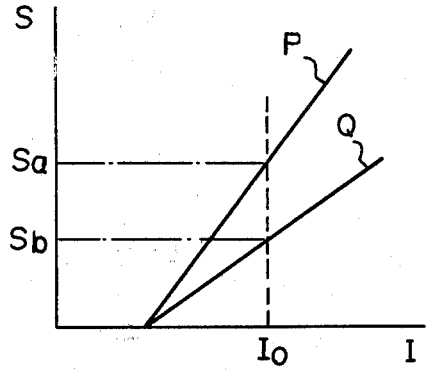
FIG. 8 is a diagram illustrating the relationship between the opening areas of the reed valves and an electric current fed into the coil.

FIG. 8 illustrates the relationship between the opening areas S of the reed valves 79, 80, 81, 82 and the electric current I fed into the coil 63. In FIG. 8, the solid line P indicates the opening area S of the reed valves 79, 81 for controlling the amount of fuel fed from the slow fuel ports 25, 41, and the solid line Q indicates the opening area S of the reed valves 80, 82 for controlling the amount of fuel fed from the main nozzle mouths 13, 31. From FIG. 8, it will be understood that, when the electric current fed into the coil 63 reaches a predetermined value, all the reed valves 79, 80, 81, 82 simultaneously open, and, that, when the electric current fed into the coil 63 is increased beyond the above-mentioned predetermined value, an increase in the opening areas of the reed valves 79, 81 is larger than that in the opening areas of the reed valves 80, 82. In the case wherein the electric current is not fed into the coil 63, since the disc 88 is urged onto the reed valves 79, 80, 81, 82 by the compression springs 67, 90, the air bleed bores 83, 84, 85, 86 are completely closed and, thus, the air bleeding operation is completely stopped. As mentioned above, in the embodiment illustrated in FIGS. 3 through 7, the air bleed bores 83, 84, 85, 86 are so arranged that the distances $m_1$ between the central axis of the electromagnetic control valve 23 and the air bleed bores 84, 86 are longer than the distances $m_2$ between the central axis of the electromagnetic control valve 23 and the air bleed bores 83, 85. However, instead of arranging the air bleed bores 83, 84, 85, 86 as mentioned above, the electromagnetic control valve 23 may be so constructed that the distances $m_1$ become equal to the distances $m_2$, and that the reed valves 79, 81 have a length $l_2$ which is longer than the length $l_1$ of the reed valves 80, 81.

Figure 9:
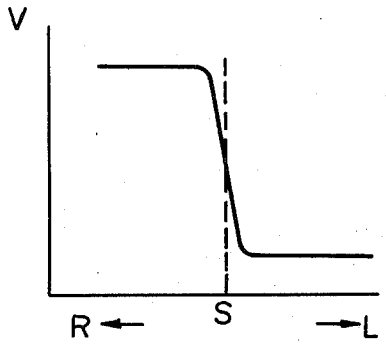
FIG. 9 is a diagram illustrating the output voltage of the oxygen concentration detector.
Figure 10:
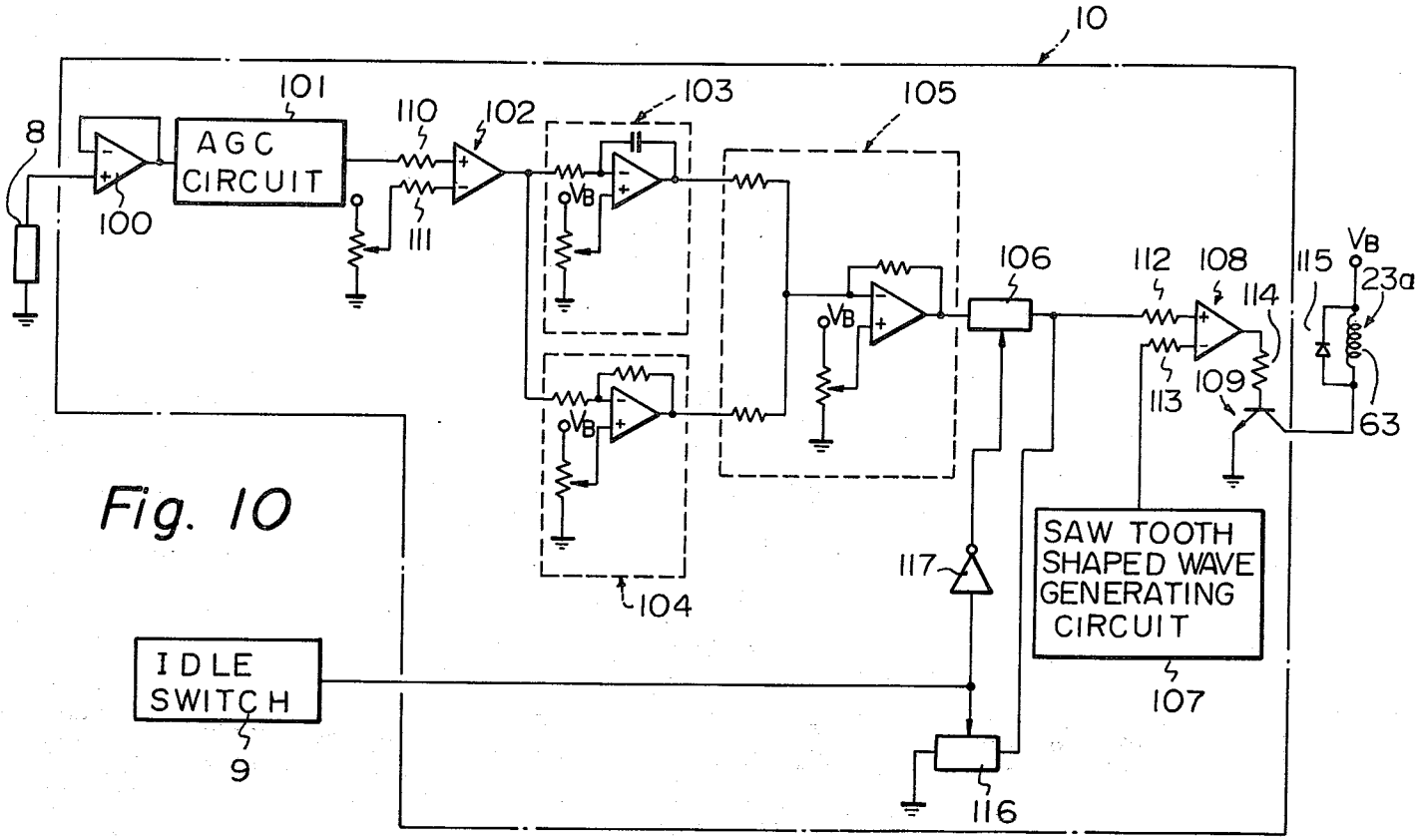
FIG. 10 is a circuit diagram of the electronic control unit.

FIG. 10 illustrates a circuit diagram of the electronic control unit 10. In FIG. 10, $V_B$ indicates a power supply voltage. Referring to FIG. 10, the oxygen concentration detector 8 illustrated in FIG. 1, is illustrated by a block 8. As illustrated in FIG. 9, the oxygen concentration detector 8 produces an output voltage of about 0.1 volts when the exhaust gas is an oxidizing atmosphere, that is, when an air-fuel ratio of the mixture fed into the cylinder of an engine is larger than the stoichiometric air-fuel ratio. On the other hand, the oxygen concentration detector 8 produces an output voltage of 0.9 volts when the exhaust gas is a reducing atmosphere, that is, when an air-fuel ratio of the mixture fed into the cylinder of an engine is less than the stoichiometric air-fuel ratio. In FIG. 9, the ordinate V indicates an output voltage of the oxygen concentration detector 8, and the abscissa indicates an air-fuel ratio of the mixture fed into the cylinder of an engine. In addition, in the abscissa, S indicates the stoichiometric air-fuel ratio, and L and R indicate the lean side and the rich side of the stoichiometric air-fuel ratio, respectively.

Turning to FIG. 10, the electronic control unit 10 comprises a voltage follower 100, an AGC circuit 101, a first comparator 102, an integrating circuit 103, a proportional circuit 104 formed by an inverting amplifier, an adder circuit 105, a first analog switch 106, a saw tooth shaped wave generating circuit 107, a second comparator 108 and a transistor 109. The output terminal of the oxygen concentration detector 8 is connected to the non-inverting input terminal of the voltage follower 100 and the output terminal of the voltage follower 100 is connected to the input terminal of the AGC circuit 101. The output terminal of the AGC circuit 101 is connected to the inverting input terminal of the first comparator 102 via a resistor 110 and a reference voltage of about 0.4 volts is applied to the non-inverting input terminal of the first comparator 102 via a resistor 111. The output terminal of the first comparator 102 is connected, on one hand, to the input terminal of the integrating circuit 103 and, on the other hand, to the input terminal of the proportional circuit 104. The output terminal of the integrating circuit 103 is connected to a first input terminal of the adder circuit 105 and the output terminal of the proportional circuit 104 is connected to a second input terminal of the adder circuit 105. The output terminal of the adder circuit 105 is connected to the non-inverting input terminal of the second comparator 108 via the first analog switch 106 and a resistor 112, and the inverting input terminal of the second comparator 108 is connected to the saw tooth shaped wave generating circuit 107 via a resistor 113. The output terminal of the second comparator 108 is connected to the base of the transistor 109 via a resistor 114. The emitter of the transistor 109 is grounded and the collector of the transistor 109 is connected to the coil 63 of the electromagnetic control valve 23 (FIG. 3). In addition, a diode 115 for absorbing surge current is connected, in parallel, to the coil 63.

Figure 11:
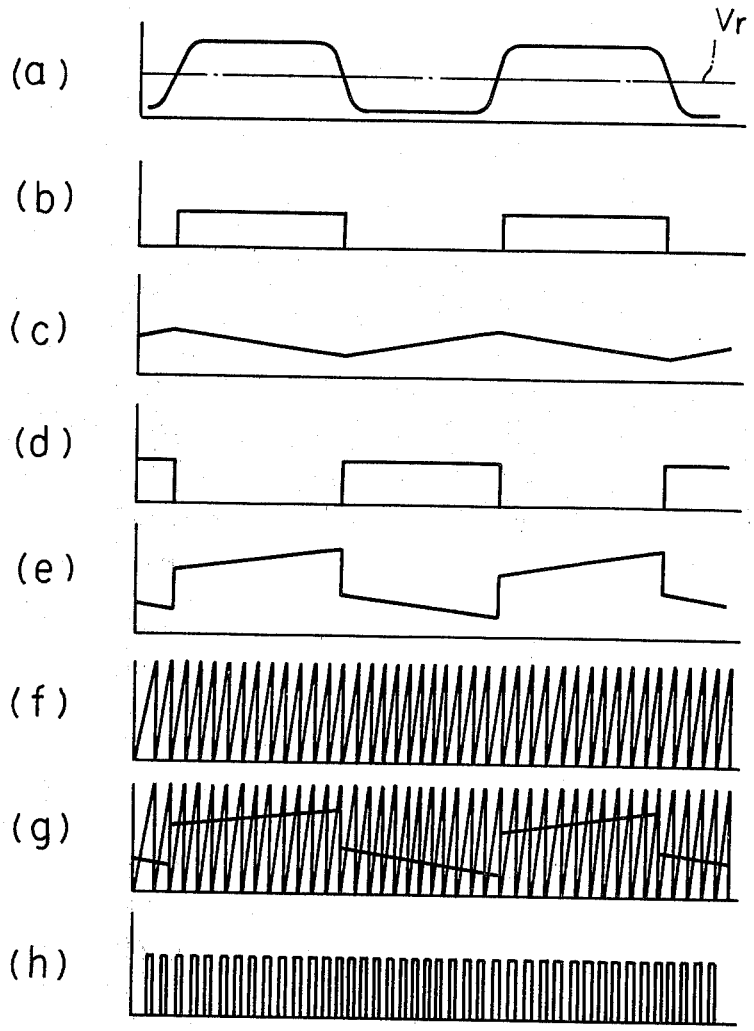
FIG. 11 is a diagram illustrating the operation of the electronic control unit.

The output signal of the oxygen concentration detector 8 is fed into the AGC circuit 101 via the voltage follower 100. The AGC circuit 101 is an amplifier which is so constructed that the gain of the amplifier is increased as the mean value of the output voltage of the oxygen concentration detector 8 is reduced and, therefore, the AGC circuit 101 produces an output voltage which is changed proportionally to the output voltage of the oxygen concentration detector 8 while maintaining the mean value of the output voltage of the AGC circuit 101 constant. FIG. 11(*a*) illustrates the output voltage of the AGC circuit 101. In addition, in FIG. 11(*a*), $V_r$ indicates the reference voltage applied to the non-inverting input terminal of the first comparator 102. The first comparator 102 produces the high level output when the output voltage of the AGC circuit 101 is reduced below the reference voltage $V_r$. Thus, the first comparator 102 produces an output voltage as illustrated in FIG. 11(*b*). The output voltage of the first comparator 102 is integrated in the integrating circuit 103 and, as a result, the integrating circuit 103 produces an output voltage as illustrated in FIG. 11(*c*). On the other hand, the output voltage of the first comparator 102 is inverted and amplified in the proportional circuit 104 and, thus, the proportional circuit 104 produces an output voltage as illustrated in FIG. 11(*d*). The output voltage of the integrating circuit 103 and the output voltage of the proportional circuit 104 are added in the adder circuit 105 and, thus, the adder circuit 105 produces an output voltage as illustrated in FIG. 11(*e*). On the other hand, the saw tooth shaped wave generating circuit 107 produces a saw tooth shaped output voltage of a fixed frequency, as illustrated in FIG. 11(*f*). If the first analog switch 106 is now in the conductive state, the output voltage of the adder circuit 105 and the output voltage of the saw tooth shaped wave generating circuit 107 are compared in the second comparator 108 as illustrated in FIG. 11(*g*). The second comparator 108 produces the high level output when the output voltage of the adder circuit 105 becomes larger than that of the saw tooth shaped wave generating circuit 107. Consequently, the second comparator 108 produces continuous pulses as illustrated in FIG. 11(*h*), and the widths of the continuous pulses are proportional to the level of the output voltage of the adder circuit 105. An electric current fed into the coil 63 is controlled by the continuous pulses, so that the amount of electric current fed into the coil 63 is increased as the widths of the continuous pulses are increased. From FIG. 11, it will be understood that, when the AGC circuit 101 produces the high level output, that is, when the air-fuel ratio of mixture fed into the cylinder of an engine becomes smaller than the stoichiometric air-fuel ratio, the widths of the continuous pulses produced at the output terminal of the second comparator 108 are increased, and, thereby, the amount of electric current fed into the coil 63 is increased. If the amount of electric current fed into the coil 63 is increased, the opening area of the reed valves 79, 80, 81, 82 is increased, as mentioned previously. As a result of this, in FIG. 2, since the amount of air fed into the main nozzle tubes 14, 32 and the fuel outflow chambers 27, 42 is increased, an air-fuel ratio of the mixture, fed into the cylinder of an engine, becomes large. After this, when an air-fuel ratio of the mixture fed into the cylinder of an engine becomes larger than the stoichiometric air-fuel ratio, the AGC circuit 101 (FIG. 10) produces the low level output. As a result of this, since the amount of electric current fed into the coil 63 is reduced, and, thereby, the amount of air fed into the main nozzle tubes 14, 32 and the fuel outflow chambers 27, 42 is reduced, an air-fuel ratio of the mixture fed into the cylinder of an engine becomes small. After this, when an air-fuel ratio of the mixture fed into the cylinder of an engine becomes smaller than the stoichiometric air-fuel ratio, the AGC circuit 101 (FIG. 10) produces the high level output. As a result of this, since the amount of air fed into the main nozzle tubes 14, 32 and the fuel outflow chambers 27, 42 is increased, an air-fuel ratio of the mixture fed into the cylinder of an engine becomes large again. Thus, an air-fuel ratio of the mixture fed into the cylinder of an engine becomes equal to the stoichiometric air-fuel ratio.

Referring to FIG. 10, the electronic control unit 10 comprises a second analog switch 116, and the connecting point of the first analog switch 106 and the resistor 112 is grounded via the second analog switch 116. The second analog switch 116 is directly controlled by the output voltage of the idle switch 9, and the first analog switch 106 is controlled by the output voltage of the idle switch 9 via an inverter 117. As mentioned previously, the idle switch 9 is turned to the ON position when the primary throttle valve 15 (FIG. 2) is in the idling position. Consequently, when the engine is operating under an idling condition, the first analog switch 116 is in the non-conductive state, and the second analog switch 116 is in the conductive state. Therefore, at this time, since the non-inverting input terminal of the second comparator 108 is grounded, the feeding operation of electronic current fed into the coil 63 is stopped and, thus, all the reed valves 79, 80, 81, 82 are closed. As a result of this, the air bleeding operation is stopped. Consequently, when the engine is operating under an idling condition, a rich-air fuel mixture is fed into the cylinder of the engine. When the primary throttle valve 15 is opened, the idle switch 9 is turned to the OFF position. As a result of this, the first analog switch 106 is turned to the conductive state, and the second analog switch 116 is turned to the non-conductive state. Consequently, at this time, the feedback control of the air bleeding operation is carried out.

As mentioned above, since the feeding operation of electric current fed into the electromagnetic control valve 23 remains stopped when the engine is operating under an idling condition, a rich air-fuel mixture is fed into the cylinder of the engine. After this, when the primary throttle valve 15 is slightly opened, since the idle switch 9 is turned to the OFF position, the feedback control of the air bleeding operation is started. At this time, fuel is fed from the slow fuel port 25, but fuel is not fed from the main nozzle mouth 13. Consequently, the amount of air fed into the fuel outflow chamber 27 from the air bleed conduit 29 is controlled by the electromagnetic control valve 23 so that an air-fuel ratio of the mixture fed into the cylinder of the engine becomes equal to the stoichiometric air-fuel ratio. That is, at this time, the movement of the reed valve 79 controlling the opening area of the air bleed bore 83 is controlled by the sliding sleeve 64 so that an air-fuel ratio of the mixture fed into the cylinder of the engine becomes equal to the stoichiometric air-fuel ratio. In addition, at this time, if the opening area of the air bleed bore 83 is indicated by 5*a* in FIG. 8, the opening area of the air bleed bore 84 connected to the main nozzle tube 14 of the primary carburetor A via the air bleed conduit 22 is indicated by $S_b$ in FIG. 8. Consequently, at this time, the opening area of the air bleed bore 84 is smaller than that of the air bleed bore 83. After this, if the primary throttle valve 15 is further opened, since the amount of air sucked into the cylinder of the engine is increased, the level of the vacuum acting on the main nozzle mouth 13 is increased. As a result of this, the feeding operation of fuel fed from the main nozzle mouth 13 is started. At this time, since fuel is mainly fed from the main nozzle mouth 13 into the air horn 11, an air-fuel ratio of the mixture fed into the cylinder of the engine is controlled by air fed into the main nozzle tube 14 from the air bleed conduit 22. On the other hand, when the feeding operation of fuel fed from the main nozzle mouth 13 is started as mentioned above, the air bleed bore 84 connected to the main nozzle tube 14 has an opening area $S_b$ (FIG. 8) which is necessary to equalize the air-fuel mixture fed into the cylinder of the engine to the stoichiometric air-fuel ratio. Consequently, when the feeding operation of fuel fed from the main nozzle mouth 13 is started, the air-fuel ratio of the mixture fed into the cylinder of the engine immediately becomes equal to the stoichiometric air-fuel ratio. Therefore, since it is possible to prevent the air-fuel mixture from becoming lean, a good accelerating operation can be obtained.

In the embodiment illustrated in FIGS. 3 and 4, the air bleed bores 79, 80, 81, 82 have the same cross-sectional area. However, instead of forming the air bleed bores 79, 80, 81, 82 so that they have the same cross-sectional area, the air bleed bores 79, 80, 81, 82 may be so formed that they have different cross-sectional areas. In addition, the opening operation of the reed valves 79, 80, 81, 82 can be easily adjusted by the adjusting screw 93 so that the reed valves 79, 80, 81, 82 open when the amount of electric current fed into the coil 63 is increased beyond a predetermined value.

Figure 12:
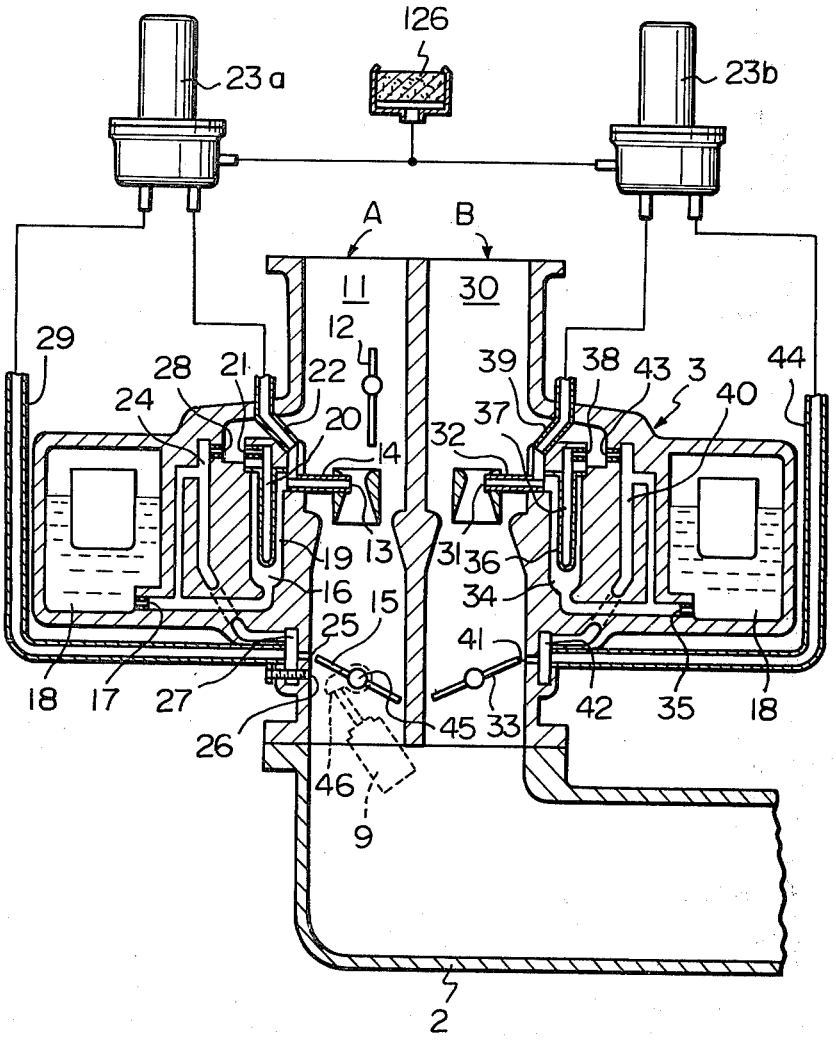
FIG. 12 is a cross-sectional side view of an alternative embodiment of a carburetor according to the present invention.
Figure 13:
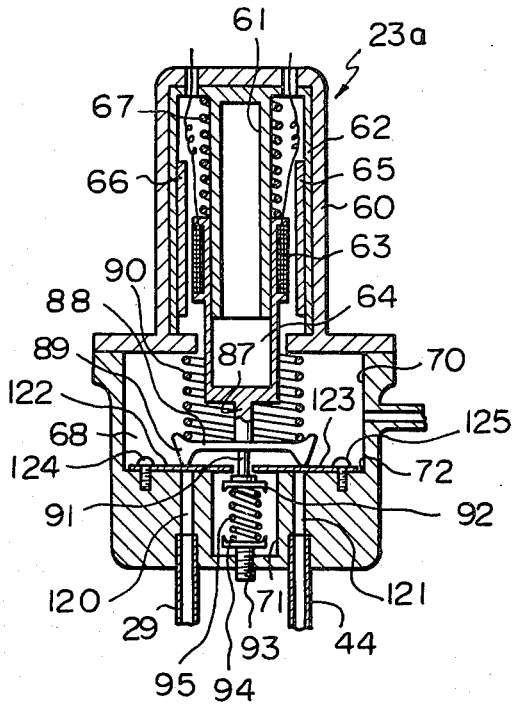
FIG. 13 is a cross-sectional side view of an electromagnetic control valve.
Figure 14:
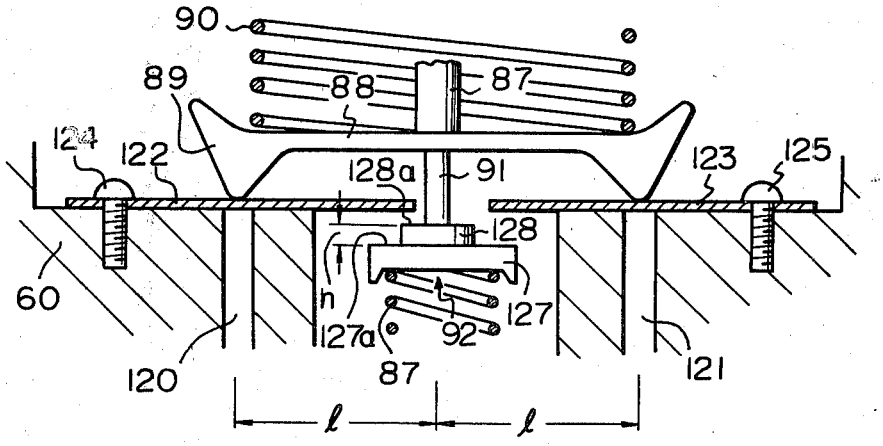
FIG. 14 is an enlarged cross-sectional side view of a portion of the electromagnetic control valve illustrated in FIG. 13.

FIGS. 12 through 14 illustrate an alternative embodiment. In this embodiment, as illustrated in FIG. 12, a pair of electromagnetic control valves 23*a* and 23*b* are provided. The electromagnetic control valves 23*a* and 23*b* have the same construction and, therefore, the construction of only the electromagnetic control valve 23*a* will be hereinafter described with reference to FIG. 13.

Referring to FIG. 13, the electromagnetic control valve 23*a* comprises a pair of air bleed bores 120 and 121, and a pair of reed valves 122 and 123 which are fixed onto the annular step portion 72 of the valve chamber 68 by means of screws 124 and 125, respectively. The air bleed bore 120 of the electromagnetic control valve 23*a* is connected to the fuel outflow chamber 27 of the primary carburetor A (FIG. 12) via the air bleed conduit 29, and the air bleed bore 121 of the electromagnetic control valve 23*a* is connected to the main nozzle tube 14 of the primary carburetor A via the air bleed conduit 22. In addition, the air bleed bore 120 of the electromagnetic control valve 23*b* (not shown) is connected to the fuel outflow chamber 42 of the secondary carburetor B via the air bleed conduit 44, and the air bleed bore 121 of the electromagnetic control valve 23*b* is connected to the main nozzle tube 32 of the secondary carburetor B via the air bleed conduit 39. In addition, as illustrated in FIGS. 12 and 13, the valve chambers 68 of the electromagnetic control valves 23*a*, 23*b* are open to the atmosphere via a common air filter 126.

Referring to FIGS. 13 and 14, the air bleed bores 120 and 121 are so formed that the distance l between the air bleed bore 120 and the central axis of the electromagnetic control valve 23*a* is equal to the distance l between the air bleed bore 121 and the central axis of the electromagnetic control valve 23*a*. On the other hand, the disc 92, fixed onto the sliding sleeve 64, comprises a base portion 127 and a reduced diameter portion 128 coaxially formed on the upper face 127*a* of the base portion 127 and having a diameter which is smaller than that of the base portion 127. Consequently, the upper face 128*a* of the reduced diameter portion 128 is higher than the upper face 127*a* of the base portion 127 by a height h. In addition, the reed valve 122 has a long length as compared with the length of the reed valve 123 so that the reed valve 122 is engageable with the upper face 128*a* of the reduced diameter portion 128, and the reed valve 123 has a short length as compared with the length of the reed valve 122 so that the reed valve 123 is engageable with the upper face 127*a* of the base portion 127. Consequently, when the disc 92 moves upward, the upper face 128*a* of the reduced diameter portion 128 comes into engagement with the tip of the reed valve 122 and causes the reed valve 122 to open the air bleed bore 120. Then, the upper face 127*a* of the base portion 127 comes into engagement with the tip of the reed valve 123 and causes the reed valve 123 to open the air bleed bore 121.

Figure 15:
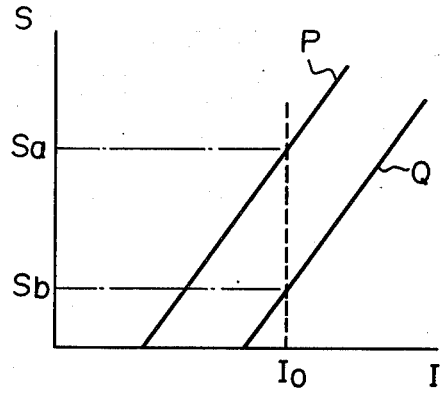
FIG. 15 is a diagram illustrating the relationship between the opening areas of the reed valves and an electric current fed into the coil.

FIG. 15 illustrates the relationship between the opening areas of the reed valves 122, 123 and the electric current I fed into the coil 63. In FIG. 15, the solid line P indicates the opening area S of the reed valve 122 for controlling the amount of fuel fed from the slow fuel ports 25, 41, and the solid line Q indicates the opening area S of the reed valve 123 for controlling the amount of fuel fed from the main nozzle mouths 13, 31. From FIG. 15, it will be understood that the solid lines P and Q extend in parallel to each other, and that the opening area of the reed valve 122 is larger than that of the reed valve 123. When an electric current is not fed into the coil 63, since the air bleed bores 120 and 121 are closed by the reed valves 122 and 123, respectively, the air bleeding operation is stopped.

In this embodiment, when the primary throttle valve 15 is slightly opened, the air bleed bore 120 has an opening area indicated by $S_a$ in FIG. 15, and the air bleed bore 121 has an opening area illustrated by $S_b$ in FIG. 15. At this time, since the fuel is fed from only the slow fuel port 25, an air-fuel ratio of the mixture fed into the cylinder of the engine is controlled by air fed into the fuel outflow chamber 27 from the air bleed conduit 29. After this, when the primary throttle valve 15 is further opened, the feeding operation of fuel fed from the main nozzle mouth 13 is started, and fuel is mainly fed from the main nozzle mouth 13 into the air horn 11. At this time, the air bleed bore 121 connected to the main nozzle tube 14 has an opening area $S_b$ (FIG. 15) which is necessary to equalize the air-fuel mixture fed into the cylinder of the engine to the stoichiometric air-fuel ratio. Consequently, when the feeding operation of fuel fed from the main nozzle mouth 13 is started, the air-fuel ratio of the mixture fed into the cylinder of the engine immediately becomes equal to the stoichiometric air-fuel ratio.

In the embodiment illustrated in FIG. 13, the air bleed bores 120, 121 have the same cross-sectional area. However, instead of forming the air bleed bores 120, 121 so that they have the same cross-sectional area, the air bleed bores 120, 121 may be so formed that they have different cross-sectional areas.

According to the present invention, the opening area of the reed valve for controlling the amount of fuel fed from the slow fuel port and the opening area of the reed valve for controlling the amount of fuel fed from the main nozzle mouth are always maintained at an opening area which is necessary to equalize the air-fuel ratio of mixture fed into the cylinder of the engine to the stoichiometric air-fuel ratio. Consequently, even if the primary throttle valve is abruptly opened, the air-fuel ratio of the mixture fed into the cylinder of the engine is maintained at the stoichiometric air-fuel ratio and, thus, a good accelerating operation of the engine can be obtained. In addition, in the embodiment illustrated in FIGS. 13 and 14, since four reed valves are formed in one piece, the reed valves can be easily assembled to the valve chamber of the electromagnetic control valve. Furthermore, since a pair of the reed valves are arranged on each side of the central axis of the electromagnetic control valve so that they are opposed to each other, it is possible to prevent the axis of the sliding sleeve from tilting relative to the normal axis and, thus, a smooth movement of the slide sleeve can always be obtained.

While the invention has been described by reference to specific embodiments chosen for purposes of illustration, it should be apparent that numerous modifications could be made thereto by those skilled in the art without departing from the basic concept and scope of the invention.

We claim:

1. An air-fuel ratio control device of an internal combustion engine having at least one cylinder, an intake passage and an exhaust passage, said device comprising:

a carburetor arranged in the intake passage and having a float chamber, a main nozzle, a main fuel passage connecting said float chamber to said main nozzle, a main air bleed passage connecting said main fuel passage to the atmosphere, a slow fuel port, a slow fuel passage connecting said float chamber to said slow fuel port, a slow air bleed passage connecting said slow fuel passage to the atmosphere;

valve means having a first valve arranged in said slow air bleed passage for controlling the flow area of said slow air bleed passage, a second valve arranged in said main air bleed passage for controlling the flow area of said main air bleed passage, and an electromagnetic device common to said first valve and said second valve and simultaneously actuating said first valve and said second valve while maintaining the flow area of said slow air bleed passage at an area which is larger than the flow area of said main air bleed passage;

an oxygen concentration detector arranged in the exhaust passage and detecting the oxygen concentration of the exhaust gas in the exhaust passage for producing a detecting signal, and;

an electronic control unit operated in response to the detecting signal of said oxygen concentration detector and producing a control signal for operating said electromagnetic device to actuate said first valve and said second valve so that an air-fuel ratio of the mixture fed into the cylinder becomes equal to a predetermined air-fuel ratio, wherein said first valve is a reed valve, and said second valve is a reed valve, said electromagnetic device comprising an axially movable rod which is actuated in response to the control signal of said electronic control unit and is engageable with said first reed valve and said second reed valve, and wherein said valve means comprises a valve chamber connected to the atmosphere an having an inner wall on which said first reed valve and said second reed valve are mounted, said slow air bleed passage having an air inlet formed on the inner wall of said valve chamber and closed by said first reed valve, said main air bleed passage having an air inlet formed on the inner wall of said valve chamber and closed by said second reed valve.

2. An air-fuel ratio control device of an internal combustion engine having at least one cylinder, an intake passage and an exhaust passage, said device comprising:

a carburetor arranged in the intake passage and having a float chamber, a main nozzle, a main fuel passage connecting said float chamber to said main nozzle, a main air bleed passage connecting said main fuel passage to the atmosphere, a slow fuel port, a slow fuel passage connecting said float chamber to said slow fuel port, a slow air bleed passage connecting said slow fuel passage to the atmosphere;

valve means having a first valve arranged in said slow air bleed passage for controlling the flow area of said slow air bleed passage, a second valve arranged in said main air bleed passage for controlling the flow area of said main air bleed passage, and an electromagnetic device common to said first valve and said second valve and simultaneously actuating said first valve and said second valve while maintaining the flow area of said slow air bleed passage at an area which is larger than the flow area of said main air bleed passage;

an oxygen concentration detector arranged in the exhaust passage and detecting the oxygen concentration of the exhaust gas in the exhaust passage for producing a detecting signal, and;

an electronic control unit operated in response to the detecting signal of said oxygen concentration detector and producing a control signal for operating said electromagnetic device to actuate said first valve and said second valve so that an air-fuel ratio of the mixture fed into the cylinder becomes equal to a predetermined air-fuel ratio, wherein said electromagnetic control device comprises a sliding sleeve having a coil and moved by a distance which is proportional to the amount of an electric current fed into said coil from said electronic control device, said valve means comprising an adjusting screw and a compression spring inserted between said sliding sleeve and said adjusting screw for adjusting the opening operation of said first valve and said second valve.

3. An air-fuel ratio control device according to claim 1, wherein said first reed valve and said second reed valve are formed in one piece.

4. An air-fuel ratio control device according to claim 1, wherein said first reed valve and said second reed valve are arranged on each side of said rod so as to be opposed to each other.

5. An air-fuel ratio control device according to claim 1, wherein said first reed valve and said second reed valve have an inner free end located near the rod of said electromagnetic device and have an outer end located remote from said rod and fixed onto the inner wall of said valve chamber, said first reed valve and said second reed valve having substantially the same length, said rod having a disc which is simultaneously engageable with the inner free ends of said first reed valve and said second reed valve, the distance between the air inlet of said main air bleed passage and an axis of said rod being longer than the distance between the air inlet of said slow air bleed passage and the axis of said rod so that an increase in the flow area of said slow air bleed passage is larger than an increase in the flow area of said main air bleed passage.

6. An air-fuel ratio control device according to claim 5, wherein said rod has another disc which is engageable with said first reed valve and said second reed valve for completely closing said first reed valve and said second reed valve.

7. An air-fuel ratio control device according to claim 1, wherein said first reed valve and said second reed valve have an inner free end located near the rod of said electromagnetic device and have an outer end located remote from said rod and fixed onto the inner wall of said valve chamber, said first reed valve having a length which is longer than that of said second reed valve, the distance between the air inlet of said main air bleed passage and an axis of said rod being substantially equal to the distance between the air inlet of said slow air bleed passage and the axis of said rod, said rod having a disc which is engageable with the inner free end of said second reed valve after said disc comes into engagement with said first reed valve when said first reed valve and said second reed valve are opened so that the flow area of said slow air bleed passage becomes larger than that of said main air bleed passage.

8. An air-fuel ratio control device according to claim 7, wherein said disc comprises a base portion which is engageable with the inner free end of said first reed valve, and a reduced diameter portion which is engageable with the inner free end of said second reed valve and has a diameter smaller than that of said base portion.

9. An air-fuel ratio control device according to claim 7, wherein said rod has another disc which is engageable with said first reed valve and said second reed valve for completely closing said first reed valve and said second reed valve.

10. An air-fuel ratio control device according to claim 1, wherein said carburetor comprises a primary carburetor and a secondary carburetor, said first valve and said second valve being arranged in the slow air bleed passage and the main air bleed passage of said primary carburetor, respectively, said valve means further comprising a third valve and a fourth valve which are actuated by said electromagnetic device and are arranged in the slow air bleed passage and the main air bleed passage of said secondary carburetor for controlling the flow areas of said slow air bleed passage and said main air bleed passage, respectively.

11. An air-fuel ratio control device according to claim 10, wherein said first valve, said second valve, said third valve and said fourth valve are reed valves arranged at 90° to each other and have a common annular portion on which said reed valves are formed in one piece.

12. An air-fuel ratio control device according to claim 11, wherein said first valve and said third valve are arranged to be opposed to each other, and said second valve and said fourth valve are arranged to be opposed to each other.

13. An air-fuel ratio control device according to claim 1, wherein said carburetor comprises a primary carburetor and a secondary carburetor, said valve means being provided for each of said primary carburetor and said secondary carburetor.

14. An air-fuel ratio control device according to claim 1, wherein said air-fuel ratio control device comprises an idle switch connected to said electronic control unit and operated when the engine is operating under an idling condition for completely closing said first valve and said second valve.

15. An air-fuel ratio control device according to claim 1, wherein said carburetor comprises a main nozzle tube having an inner end and an outer end exposed to the intake passage, said main air bleed passage being connected to the inner end of said main nozzle tube.

16. An air-fuel ratio control device according to claim 1, wherein a fuel outflow chamber is formed between said slow fuel port and said slow fuel passage, said slow air bleed passage being connected to said fuel outflow chamber.

* * * * *